US010409219B2

(12) United States Patent
Morioka

(10) Patent No.: US 10,409,219 B2
(45) Date of Patent: Sep. 10, 2019

(54) IMAGE FORMING DEVICE WITH BLOWING MECHANISM

(71) Applicant: Konica Minolta, Inc., Chiyoda-ku, Tokyo (JP)

(72) Inventor: Toshimitsu Morioka, Toyokawa (JP)

(73) Assignee: KONICA MINOLTA INC., Tokyo (JP)

( * ) Notice: Subject to any disclaimer, the term of this patent is extended or adjusted under 35 U.S.C. 154(b) by 0 days.

(21) Appl. No.: 16/025,045

(22) Filed: Jul. 2, 2018

(65) Prior Publication Data

US 2019/0004475 A1 Jan. 3, 2019

(30) Foreign Application Priority Data

Jul. 3, 2017 (JP) ..... 2017-130404

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS 6,061,536 A * 5/2000 Cho ..... G03G 15/107 399/92
7,233,762 B2 * 6/2007 Kunii ..... G03G 15/169 219/216
7,313,355 B2 * 12/2007 Isobe ..... B41J 29/377 399/341
2002/0064404 A1 * 5/2002 Iwai ..... G03G 15/234 399/309
2002/0090236 A1 * 7/2002 Omata ..... G03G 15/232 399/309
2003/0035665 A1 * 2/2003 Sakamoto ..... G03G 15/161 399/309
2003/0235442 A1 * 12/2003 Suzuki ..... G03G 15/167 399/309
2004/0101332 A1 * 5/2004 Sohmiya ..... G03G 15/1625 399/307
2005/0196204 A1 * 9/2005 Funato ..... G03G 15/2014 399/341
2006/0284960 A1 * 12/2006 Kishi ..... G03G 15/2017 347/140

(Continued)

FOREIGN PATENT DOCUMENTS

JP 2008014980 A * 1/2008
JP 2009098424 A 5/2009

(Continued)

OTHER PUBLICATIONS

Machine translation of JP 2008014980 A (Year: 2008).*

*Primary Examiner* — David J Bolduc
(74) *Attorney, Agent, or Firm* — Cantor Colburn LLP

(57) ABSTRACT

An image forming device includes: an endless belt that transfers an image onto a sheet; a driving mechanism that drives the endless belt; a nip that transfers an image onto the sheet; a pressing rotational part that presses a front side of the endless belt that is a face onto which an image is transferred, and is rotated together with movement of the endless belt; and an blowing mechanism to blow out air to the pressing rotational part.

14 Claims, 9 Drawing Sheets

(56) References Cited

U.S. PATENT DOCUMENTS

2007/0196117 A1* 8/2007 Ishii ..... G03G 21/12 399/35
2007/0212104 A1* 9/2007 Miyamoto ..... G03G 21/206 399/92
2007/0230989 A1* 10/2007 Maeda ..... G03G 15/161 399/92
2008/0038008 A1* 2/2008 Fujita ..... G03G 21/206 399/92
2008/0304879 A1* 12/2008 Tamura ..... G03G 15/0194 399/307
2009/0297235 A1* 12/2009 Nishimura ..... G03G 15/2064 399/329
2010/0008683 A1* 1/2010 Yoshikawa ..... G03G 15/1695 399/45
2010/0226681 A1* 9/2010 Okuda ..... G03G 15/2064 399/92
2011/0026964 A1* 2/2011 Yasumoto ..... G03G 15/50 399/94
2011/0064487 A1* 3/2011 Ichihashi ..... G03G 15/161 399/302
2012/0121286 A1* 5/2012 Suzuki ..... G03G 15/6573 399/67
2014/0147160 A1* 5/2014 Konishi ..... G03G 21/206 399/92
2014/0205307 A1* 7/2014 Tanaka ..... G03G 15/2017 399/43
2015/0261137 A1* 9/2015 Mitani ..... G03G 15/161 399/101
2016/0246221 A1* 8/2016 Dedic ..... G03G 15/2014
2018/0059567 A1* 3/2018 Wakimoto ..... G03G 15/0189

FOREIGN PATENT DOCUMENTS

JP 2011064762 A 3/2011
JP 2016118720 A 6/2016

* cited by examiner

IMAGE FORMING DEVICE WITH BLOWING MECHANISM

CROSS REFERENCE OF RELATED APPLICATION(S)

The present application claims priority under 35 U.S.C. § 119 to Japanese patent Application No. 2017-130404, filed on Jul. 3, 2017, the entire contents of which are incorporated herein by reference.

BACKGROUND

Technological Field

The present invention relates to an image forming device. The image forming device includes an electrophotographic device such as a digital copier, a facsimile machine, and a printer, a recording apparatus, a display device, and the like regardless of color or monochrome.

Description of the Related Art

In recent years, an image forming device is downsized more and more. JP 2011-064762 A discloses an image forming device in which a direction change roller is provided to change a track of an intermediate belt provided in an intermediate transfer unit included in an image forming device.

JP 2016-118720 A discloses a structure in which warm air is blown to a nip in order to warm up a secondary transfer portion utilizing fixing heat and improve transferability. JP 2009-098424 A discloses a structure in which a blowing member to blow air onto a sheet is provided in an upstream side of a nip in order to correct a curled state of a sheet conveyed.

In an image forming device provided with a direction change roller described above, the direction change roller using an iron shaft has a structure closely contacting a front side of an intermediate belt. The intermediate transfer unit having the direction change roller has a structure detachable from a main body of the image forming device in order to replace the intermediate belt.

The intermediate transfer unit has a structure integrating not only the intermediate belt but also a driving roller, a secondary transfer roller, a tension roller, a primary transfer roller, the direction change roller, and other components. At the time of replacing the intermediate belt, the direction change roller may contact external air and a foreign matter may adhere to the direction change roller.

Since an image is placed on the front side of the intermediate belt, in a case where a foreign matter adheres to the surface of the direction change roller and the intermediate belt is rotated with the foreign matter adhering thereto, there may be a problem that the front side of the intermediate belt is damaged and an adverse effect is given to image forming.

To solve such a problem, it is also conceivable to provide a blade arranged in a manner facing the direction change roller in order to remove a foreign matter adhering to the surface of the direction change roller. However, since the blade slides on the surface of the direction change roller while contacting the same, the surface of the direction change roller may be damaged. In a case where the surface of the direction change roller is damaged, there may be a problem that the front side of the intermediate belt is damaged when a damaged portion (irregularities) of the surface of the direction change roller contacts and slides the front side of the intermediate belt.

SUMMARY

The present invention has been made in view of the above-described problems, and an object thereof is to provide an image forming device having a structure in which: a surface of a direction change roller is not damaged at the time of removing a foreign matter in a case of removing the foreign matter adhering to the surface of the direction change roller; and furthermore, a foreign matter is prevented from adhering to the surface of the direction change roller.

To achieve the abovementioned object, according to an aspect of the present invention, an image forming device reflecting one aspect of the present invention comprises: an endless belt that transfers an image onto a sheet; a driving mechanism that drives the endless belt; a nip that transfers an image onto the sheet; a pressing rotational part that presses a front side of the endless belt that is a face onto which an image is transferred, and is rotated together with movement of the endless belt; and an blowing mechanism to blow out air to the pressing rotational part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
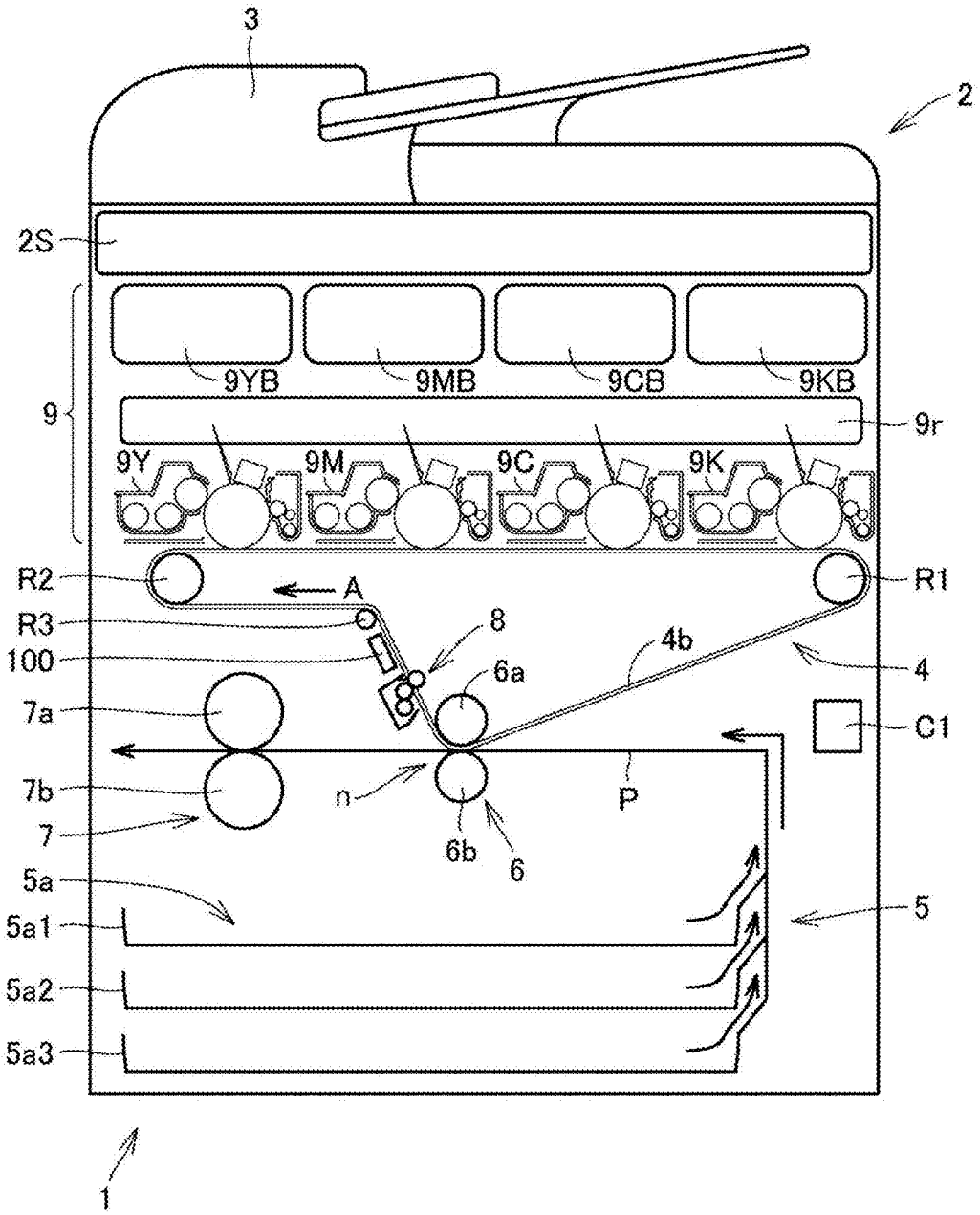
FIG. 1 is a schematic view illustrating an internal structure of an image forming device according to an embodiment.

Hereinafter, an image forming device according to one or more embodiments of the present invention will be described with reference to the drawings. However, in a case where reference is made to number, an amount, and the like in the embodiments described below, the scope of the invention is not necessarily limited to the number, the amount, and the like, unless otherwise particularly specified. Same components or equivalent components are denoted by same reference signs, and the same description may not be repeated. In the drawings, not that there may be a portion not illustrated in accordance with an actual dimension and illustrated in a changed ratio in order to facilitate understanding for a structure.

(Image Forming Device 1)

An image forming device 1 of the present embodiment will be described with reference to FIG. 1. FIG. 1 is a schematic view illustrating an internal structure of the image forming device 1. This image forming device 1 is a so-called multi function peripheral (MFP) capable of executing a copy job, a print job, a scan job, a fax job, and a box job. The box job is a job executed using data stored in a box (folder) included in the image forming device 1.

The image forming device 1 mainly includes an image former (intermediate transfer unit) 4, an automatic document conveyer 3, a document reader 2, an exposure device 9, and a sheet feeder 5, and executes image forming on the basis of print setting. The document reader 2 includes a scanner 2S. The automatic document conveyer 3 automatically conveys a document placed on the scanner 2S to a reading position of the document reader.

The document reader 2 reads an image of the document conveyed by the automatic document conveyer 3 and generates read data. A plurality of sheet feeders 5 is provided. Sheets P stored in the respective sheet feeders 5 are supplied to the image former 4. In the present embodiment, the sheet feeders include a first sheet feeder 5*a*1, a second sheet feeder 5*a*2, and a third sheet feeder 5*a*3.

The image former 4 forms an image on a sheet P supplied from a sheet feeder 5 on the basis of read data generated by the document reader 2 or print data acquired by a data interface (IF).

The exposure device 9 includes an exposurer 9*r*, a yellow (Y) imaging unit 9Y, a magenta (M) imaging unit 9M, a cyan (C) imaging unit 9C, and a black (K) imaging unit 9K. A yellow (Y) toner bottle 9YB is arranged above the yellow (Y) imaging unit 9Y, a magenta (M) toner bottle 9MB is arranged above the magenta (M) imaging unit 9M, a cyan (C) toner bottle 9CB is arranged above the cyan (C) imaging unit 9M, and a black (K) toner bottle 9KB is arranged above the black (K) imaging unit 9K.

The image former 4 includes: an intermediate belt 4*b* serving as an intermediate transfer member used in common for colors of Y to K; registration rollers R1 and R2, a secondary transfer portion 6, a cleaner 8, and a fixer 7. The intermediate belt 4*b* is passed around between the registration rollers R1 and R2, and an endless belt having an endless track is used.

Secondary transfer rollers 6*a* and 6*b* constituting the secondary transfer portion 6 are provided between the registration rollers R1 and R2. A nip n at which the intermediate belt 4*b* and a sheet P is nipped by the secondary transfer rollers 6*a* and 6*b* to transfer an image onto the sheet P is formed.

In a conveyance direction of the sheet P, the fixer 7 is provided on a downstream side of the secondary transfer rollers 6*a* and 6*b* in order to fix the image that has been transferred onto the sheet P. The fixer 7 includes a pair of fixing rollers 7*a* and 7*b*.

A direction change roller R3 serving as a pressing rotational part is provided between the registration roller R2 and the secondary transfer portion 6 in order to change a track direction of the intermediate belt 4*b*, and the direction change roller R3 presses a front side of the intermediate belt 4*b* that is a face onto which an image located is transferred. Since the cleaner 8 is provided on an upstream side of the direction change roller R3, a foreign matter existing on the intermediate belt 4*b* can be precluded by the cleaner 8 before the foreign matter adhering to the direction change roller R3, and a foreign matter existing before entrance to the nip n can be removed.

The image former 4 can be freely drawn out to a front side (operation side) of the image forming device 1 by a mechanism (not illustrated) at the time of maintenance, in event of conveyance trouble of a sheet P, and the like.

The image former 4 in the present embodiment has a blowing mechanism to blow air to the direction change roller R3 serving as the pressing rotational part. In the following, forms of the blowing mechanism will be described with reference to the drawings. Note that it is preliminarily designed that structures of respective Examples are used in combination as appropriate.

Example 1

Figure 2:
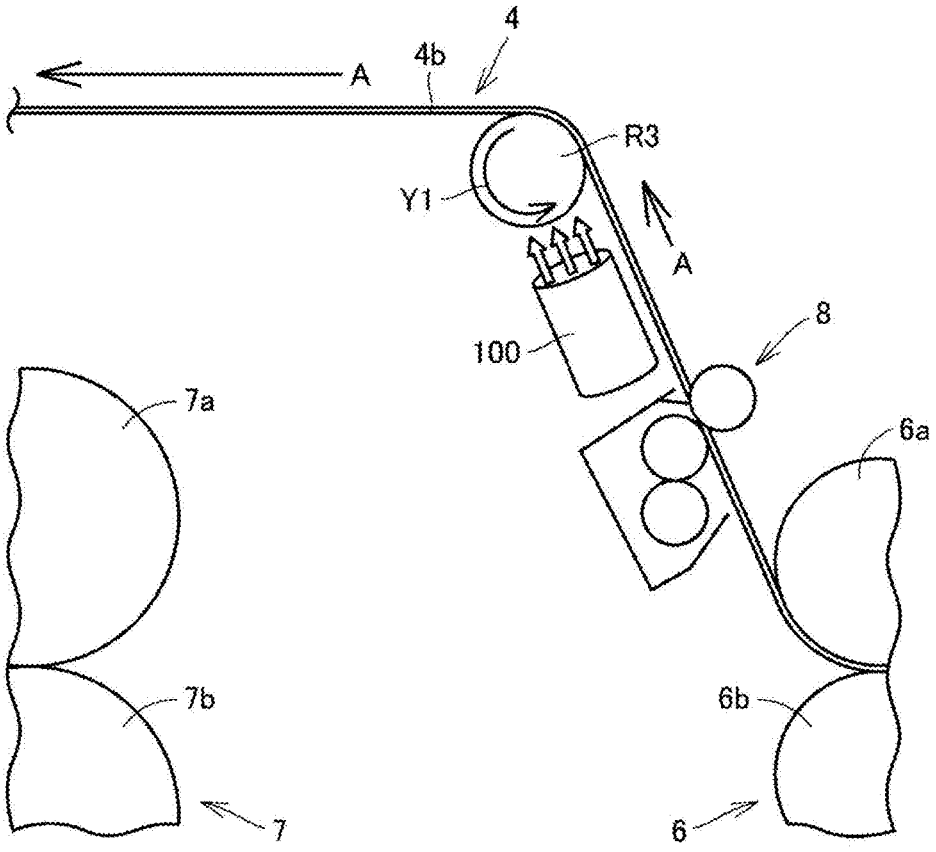
FIG. 2 is a view illustrating a structure of a blowing mechanism in Example 1.

A structure of a blowing mechanism 100 in Example 1 will be described with reference to FIG. 2. FIG. 2 is a view illustrating the structure of the blowing mechanism 100 in Example 1. The blowing mechanism 100 is arranged between a direction change roller R3 and a nip n, and blows air to the direction change roller R3 in a direction same as a driving direction of an intermediate belt 4*b* (direction indicated by an arrow A in FIG. 2). As the blowing mechanism 100, a fan or the like is used. Using the blowing mechanism 100, a foreign matter adhering to a surface of the direction change roller R3 can be blown away, and the intermediate belt 4*b* can be prevented from being damaged.

Example 2

Figure 3:
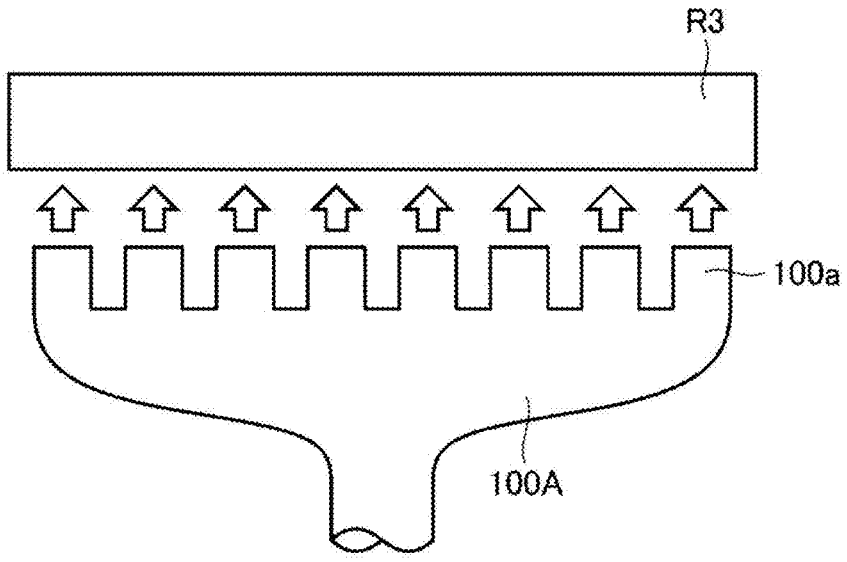
FIG. 3 is a view illustrating a structure of a blowing mechanism in Example 2.

A structure of a blowing mechanism 100A in Example 2 will be described with reference to FIG. 3. FIG. 3 is a view illustrating the structure of the blowing mechanism 100A in Example 2. The blowing mechanism 100A of Example 2 has a port to blown out air, and the port has a duct-like shape extending in a longitudinal direction of a direction change roller R3, and further the blowing mechanism is provided with a blowing port 100*a* divided into a plurality of portions at a position facing the direction change roller R3.

Using the blowing mechanism 100A, a foreign matter adhering to a surface of the direction change roller R3 can be blown away by blowing the air to an entire part in the longitudinal direction of the direction change roller R3, and an intermediate belt 4*b* can be prevented from being damaged.

Example 3

Figure 4:
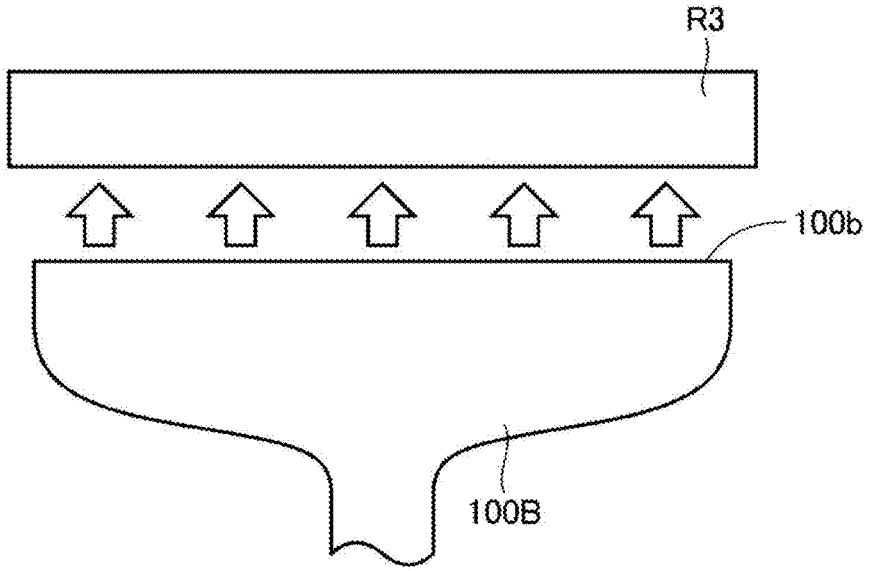
FIG. 4 is a view illustrating a structure of a blowing mechanism in Example 3.

A structure of a blowing mechanism 100B in Example 3 will be described with reference FIG. 4. FIG. 4 is a view illustrating the structure of the blowing mechanism 100B in Example 3. The blowing mechanism 100B of Example 3 has a port to blown out air, and the port has a duct-like shape extending in a longitudinal direction of a direction change roller R3, and further the blowing mechanism is provided with a blowing port 100*b* extending in a longitudinal direction of a direction change roller R3 at a position facing the direction change roller R3.

Using the blowing mechanism 100B, a foreign matter adhering to a surface of the direction change roller R3 can be blown away by blowing air to an entire part in the longitudinal direction of the direction change roller R3, and an intermediate belt 4*b* can be prevented from being damaged.

Example 4

Figure 5:
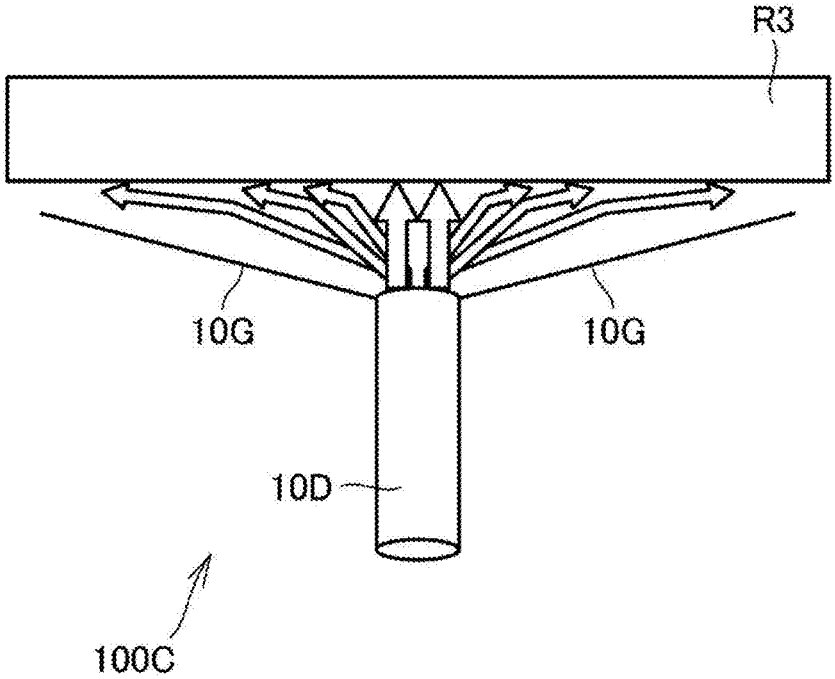
FIG. 5 is a view illustrating a structure of a blowing mechanism in Example 4.

A structure of a blowing mechanism 100C in Example 4 will be described with reference FIG. 5. FIG. 5 is a view illustrating the structure of the blowing mechanism 100C in Example 4. The blowing mechanism 100C in Example 4 has a duct 10D to blow air to a center in a longitudinal direction of a direction change roller R3. Furthermore, provided is a pair of guards 10G that guides the air having hit the center to both ends of the direction change roller R3.

Using the blowing mechanism 100C, a foreign matter adhering to a surface of the direction change roller R3 can be blown away by blowing air to an entire part in the longitudinal direction of the direction change roller R3, and an intermediate belt 4*b* can be prevented from being damaged.

Example 5

Figure 6:
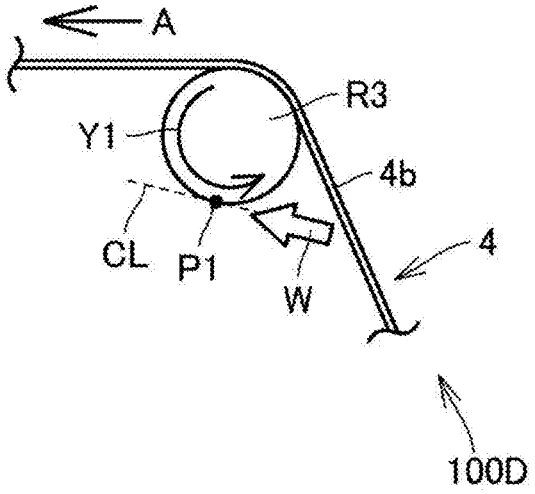
FIG. 6 is a conceptual view illustrating a structure of a blowing mechanism in Example 5.

A structure of a blowing mechanism 100D in Example 5 will be described with reference FIG. 6 and FIG. 7. FIG. 6 is a conceptual view illustrating the structure of the blowing mechanism 100D in Example 5, and FIG. 7 is a view illustrating a specific structure of the blowing mechanism 100D in Example 5.

Referring to FIG. 6, the blowing mechanism 100D in Example 5 defines a direction of air blown from the blowing mechanism 100D. Specifically, adopted is a structure in which the air is blown in a direction opposing to a rotational direction of a direction change roller R3 (direction Y1 in FIG. 6 and FIG. 7) and also in a tangential direction with respect to the direction change roller R3. In FIG. 6, the air is blown in an extending direction of a tangent line CL with respect to a contact point P1 of the direction change roller R3.

Figure 7:
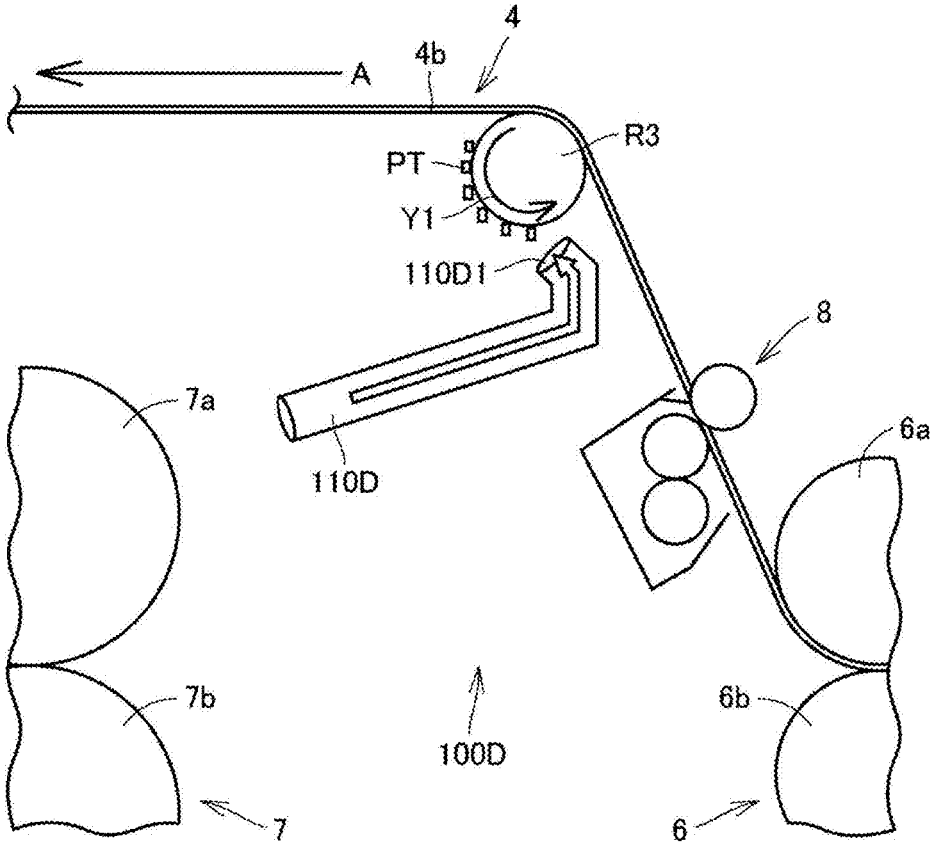
FIG. 7 is a view illustrating a specific structure of the blowing mechanism in Example 5.

Referring to FIG. 7, as a specific structure, a structure that can easily blow the air in the tangential direction with respect to the direction change roller R3 can be implemented by using a duct 110D having a blowing portion 110D1 bent toward the direction change roller R3.

Using the blowing mechanism 100D, a foreign matter adhering to a surface of the direction change roller R3 (PT in FIG. 7) can be blown away, and an intermediate belt 4*b* can be prevented from being damaged.

Example 6

Figure 8:
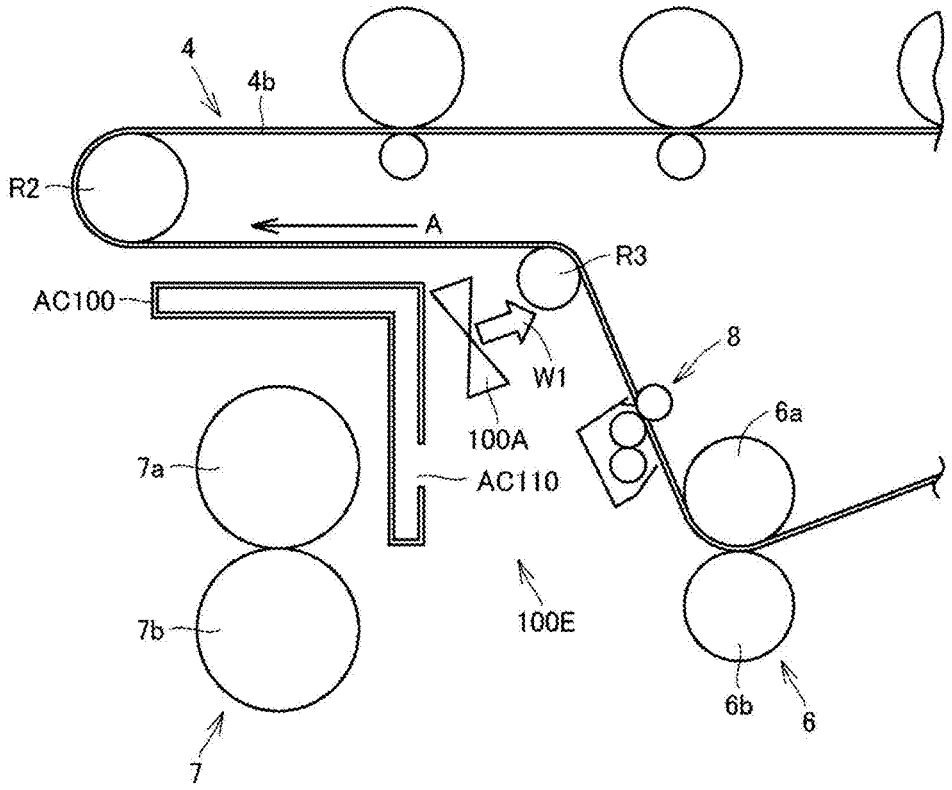
FIG. 8 is a view illustrating a structure of a blowing mechanism in Example 6.

A structure of a blowing mechanism 100E in Example 6 will be described with reference FIG. 8. FIG. 8 is a view illustrating the structure of the blowing mechanism 100E in Example 6. In an image forming device in this Example, an air curtain mechanism AC that suppresses heat generated from a fixer 7 from reaching a direction change roller R3 side is provided between the fixer 7 and the direction change roller R3.

This air curtain mechanism AC has a duct AC100 to which air is fed in a longitudinal direction of the direction change roller R3, and the air is blown out toward the direction change roller R3 side from an opening AC110 provided in the duct AC100. Additionally, a fan 100A is arranged between the duct AC100 and the direction change roller R3, and the air is blown toward the direction change roller R3 (direction indicated by an arrow W1 in FIG. 8). Thus, in this Example, the air curtain mechanism AC is used as the blowing mechanism 100E.

Using the blowing mechanism 100E, a foreign matter adhering to a surface of the direction change roller R3 can be blown away, and an intermediate belt 4*b* can be prevented from being damaged without upsizing the image forming device.

On the other hand, the air blown from the air curtain mechanism AC may be warmed by the heat generated from the fixer 7. In this case, it can be expected that power to warm each device can be saved by warming an intermediate transfer member.

Example 7

Figure 9:
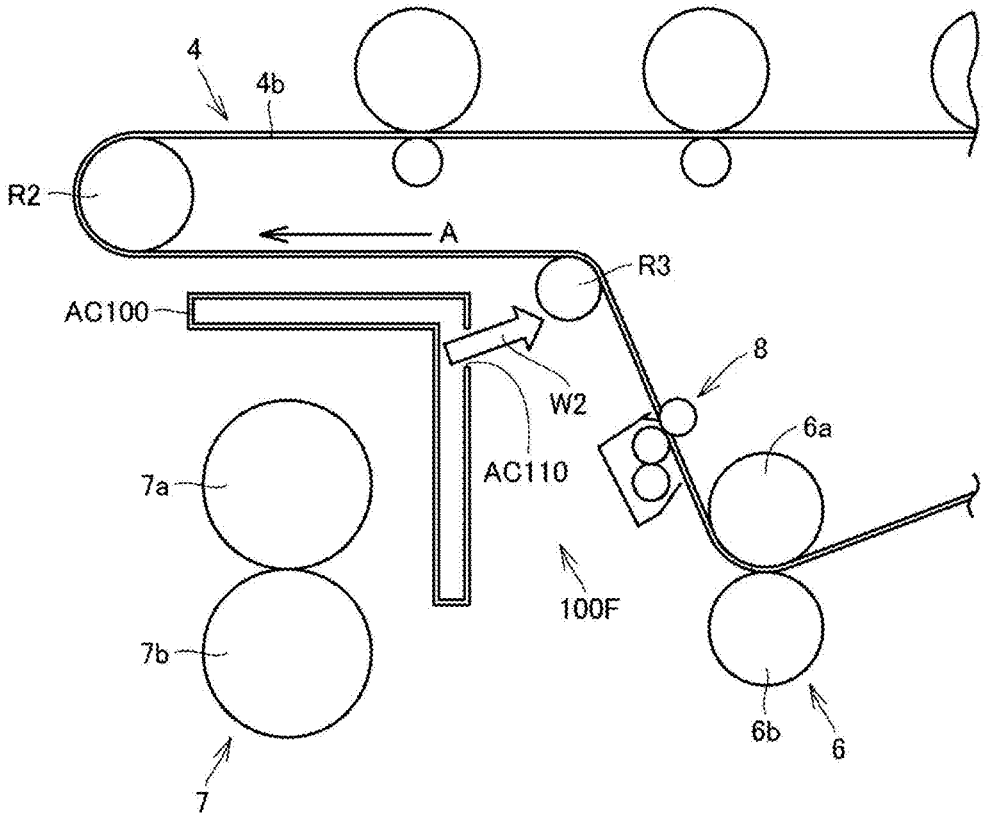
FIG. 9 is a view illustrating a structure of a blowing mechanism in Example 7.

A structure of a blowing mechanism 100F in Example 7 will be described with reference FIG. 9. FIG. 9 is a view illustrating the structure of the blowing mechanism 100F in Example 7. In FIG. 9, in an image forming device in this Example, an air curtain mechanism AC that suppresses heat generated from a fixer 7 from reaching a direction change roller R3 side is provided between the fixer 7 and the direction change roller R3 in a manner similar to Example 6.

In a duct AC100 of the air curtain mechanism AC, air blown out from an opening AC110 opened to the direction change roller R3 is blown toward the direction change roller R3 (direction indicated by an arrow W2 in FIG. 9) in a manner different from Example 6. Thus, in this Example also, the air curtain mechanism AC is used as the blowing mechanism 100F.

Using the blowing mechanism 100F, a foreign matter adhering to a surface of the direction change roller R3 can be blown away, and an intermediate belt 4*b* can be prevented from being damaged without upsizing the image forming device.

Example 8

Figure 10:
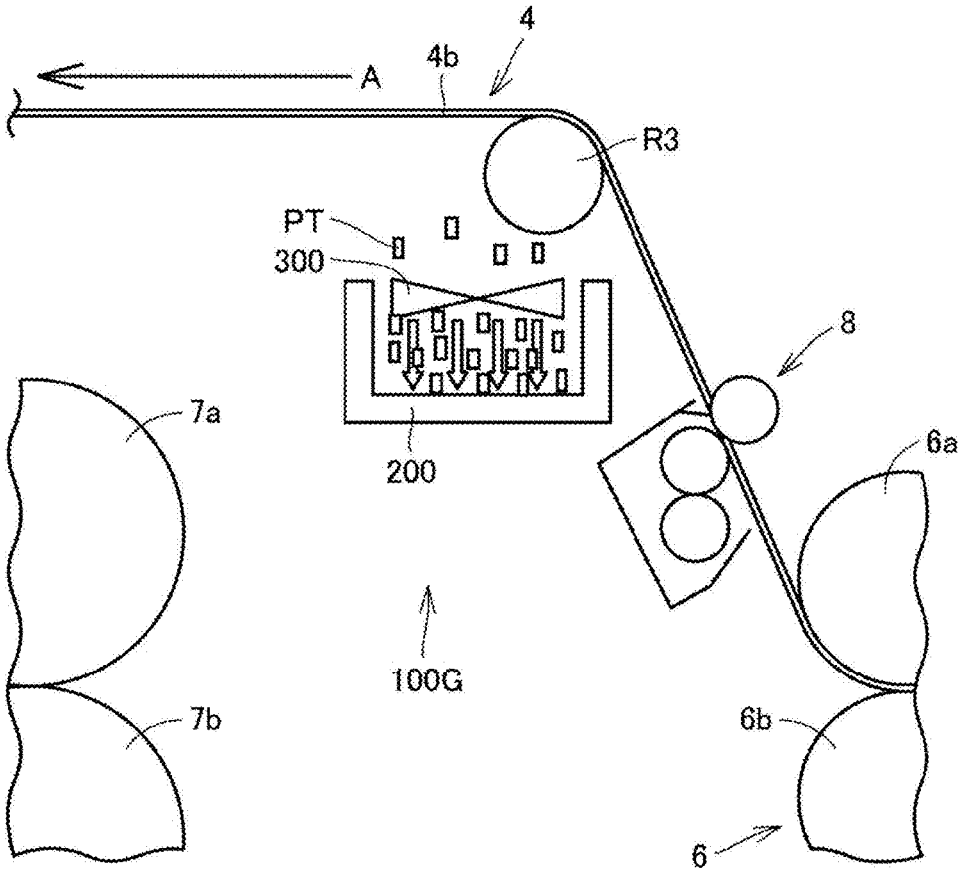
FIG. 10 is a view illustrating a structure of a blowing mechanism in Example 8.

A structure of a blowing mechanism 100G in Example 8 will be described with reference FIG. 10. FIG. 10 is a view illustrating the structure of a blowing mechanism 100G in Example 8. In FIG. 10, in an image forming device of this Example, a collecting part 200 that collects an adhering matter PT having been separated from a direction change roller R3 by a blowing mechanism adopted in each of Examples described above is further provided below the direction change roller R3. With this structure, the adhering matter PT can be prevented from spreading inside the image forming device.

Preferably, as illustrated in FIG. 10, a fan 300 serving as a suctioner to generate an air flow directed from the direction change roller R3 to the collecting part 200 is further provided above the collecting part 200. With this structure, the adhering matter PT having been separated from the direction change roller R3 can be effectively collected.

Example 9

Figure 11:
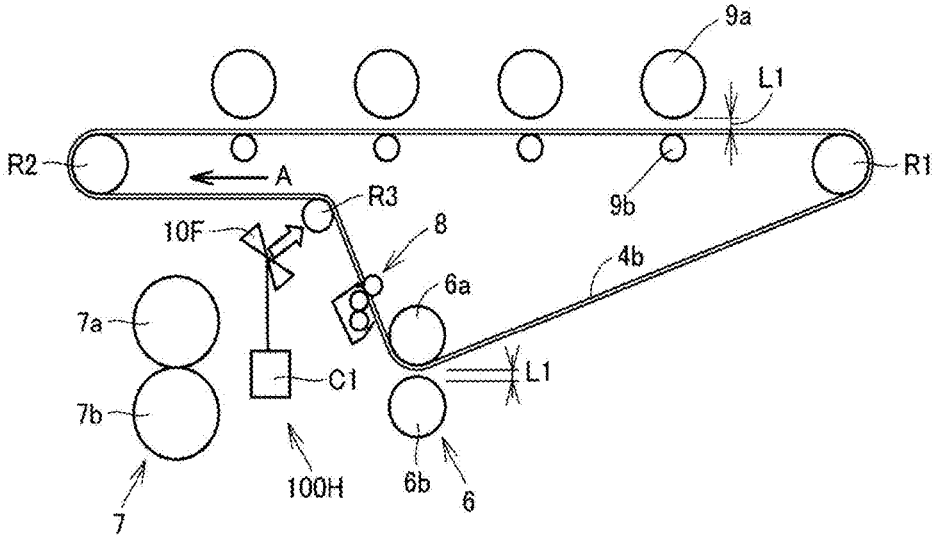
FIG. 11 is a view illustrating a case where a fan is used as a blowing device incorporated in a blowing mechanism in each Example.

A structure of a blowing mechanism 100H in Example 9 will be described with reference FIG. 11. FIG. 11 is a view illustrating a case where a fan 10F is used as a blowing device incorporated in a blowing mechanism in each Example described above. In the following, a control method for an image forming device and a control method for the fan 10F by a controller C1 will be described.

In a case where a unit of an intermediate transfer member is drawn out from the image forming device for maintenance of the image forming device or the like, a foreign matter (dust) outside the image forming device may adhere to an intermediate belt 4*b*. When the intermediate belt 4*b* is operated in a case where the unit of the intermediate transfer member is put back to the image forming device with the foreign matter adhering to the intermediate belt 4*b*, the intermediate belt 4*b* may be damaged when a photoreceptor and secondary transfer rollers contact, in a pressed manner, the intermediate belt 4*b* with the foreign matter adhering thereto.

Considering this, as the timing to drive the fan 10F, it is preferable to control the fan 10F to be driven in a state in which secondary transfer rollers 6*a* and 6*b* at a secondary transfer portion 6 are controlled to be separated once from each other (by a distance L1 in FIG. 11) by the controller C1 when the unit of the intermediate transfer member drawn out to the outside of the image forming device is put back to the inside of the image forming device. Similarly, it is preferable to control the fan 10F to be driven in a state in which primary transfer rollers 9*a* and 9*b* included in an exposure device 9 are controlled to be separated from each other (by a distance L1 in FIG. 11) by the controller C1. With this structure, the intermediate belt 4*b* can be prevented from being damaged.

As another control method for the fan 10F using the controller C1, power can be saved by changing an air amount, more specifically, when the unit of the intermediate transfer member is put back from the outside to the inside of the image forming device or the like, the air amount is increased at the timing when relatively many foreign matters seem to adhere to a surface of the intermediate belt 4*b*, and the air amount is decreased at the timing other than that.

Although embodiments of the present invention have been described and illustrated in detail, it should be considered that the disclosed embodiments and Examples are made for purposes of illustration and example only and not limitation. The scope of the present invention should be interpreted by terms of the appended claims and intended to include any change within the meaning and the scope equivalent to the scope of claims.

What is claimed is:

1. An image forming device comprising:
an endless belt that transfers an image onto a sheet;
a driving mechanism that drives the endless belt;
a nip that transfers an image onto the sheet;
a pressing rotational part that presses a front side of the endless belt that is a face onto which an image is transferred, and is rotated together with movement of the endless belt; and
a blowing mechanism to blow across an outer surface of the pressing rotational part.

2. The image forming device according to claim 1, wherein
the blowing mechanism
is arranged between the pressing rotational part and the nip, and
blows air toward the pressing rotational part in a direction same as a driving direction of the endless belt.

3. The image forming device according to claim 2, wherein a direction of the air blown out from the blowing mechanism is a direction opposing to a rotational direction of the pressing rotational part and is a tangential direction with respect to the pressing rotational part.

4. The image forming device according to claim 1, wherein the blowing mechanism blows air to a center in a longitudinal direction of the pressing rotational part.

5. The image forming device according to claim 4, wherein the blowing mechanism blows air to the center in the longitudinal direction of the pressing rotational part, and further guides the air having hit the center to both ends of the pressing rotational part.

6. The image forming device according to claim 1, wherein the blowing mechanism has a port to blow out air, and the port has a duct-like shape extending in the longitudinal direction of the pressing rotational part.

7. The image forming device according to claim 1, wherein the blowing mechanism is a fan.

8. An image forming device comprising:
an endless belt that transfers an image onto a sheet;
a driving mechanism that drives the endless belt;
a nip that transfers an image onto the sheet;
a pressing rotational part that presses a front side of the endless belt that is a face onto which an image is transferred, and is rotated together with movement of the endless belt;
an blowing mechanism to blow out air to the pressing rotational part
a fixer that fixes an image that has been transferred onto the sheet; and
an air curtain mechanism that is arranged between the fixer and the pressing rotational part and suppresses heat generated from the fixer from reaching the pressing rotational part side,
wherein the air curtain mechanism is used as the blowing mechanism.

9. The image forming device according to claim 8, wherein in a case where the air curtain mechanism is used as the blowing mechanism, a port to blow air from the air curtain mechanism has a duct-like shape extending in the longitudinal direction of the pressing rotational part.

10. The image forming device according to claim 1, further comprising a collecting part which is arranged below the pressing rotational part and collects an adhering matter that has been separated from the pressing rotational part.

11. The image forming device according to claim 10, further comprising a suctioner which is arranged above the collecting part and generates an air flow directed from the pressing rotational part to the collecting part.

12. The image forming device according to claim 1, further comprising a controller that controls timing to drive the blowing mechanism.

13. The image forming device according to claim 1, further comprising a controller that controls an air amount blown out from the blowing mechanism to the pressing rotational part.

14. The image forming device according to claim 1, wherein a cleaner that removes an adhering matter existing on a front side of the endless belt is arranged in an opposite direction of the pressing rotational part with respect to a driving direction of the endless belt.

* * * * *